US005780793A

United States Patent [19]

Buchholz et al.

[11] Patent Number: 5,780,793

[45] Date of Patent: Jul. 14, 1998

[54] SAFETY SWITCH HAVING A CARBON FIBER CONDUCTOR

[75] Inventors: Hans-Volker Buchholz, Hildesheim; Wolfgang Opitz, Bockenem, both of Germany

[73] Assignee: Meteor Gummiwerke K. H. Bädje GmbH & Co., Bockenem, Germany

[21] Appl. No.: 535,130

[22] PCT Filed: Jan. 29, 1994

[86] PCT No.: PCT/EP94/00255

§ 371 Date: Oct. 10, 1995

§ 102(e) Date: Oct. 10, 1995

[87] PCT Pub. No.: WO94/25972

PCT Pub. Date: Nov. 10, 1994

[30] Foreign Application Priority Data

Apr. 30, 1993 [DE] Germany ..... 43 14 193.5

[51] Int. Cl.[6] ..... H01H 3/16; H01H 1/02

[52] U.S. Cl. ..... 200/61.44; 200/61.43; 200/262

[58] Field of Search ..... 200/5 A, 262–269, 200/512–517, 86 R, 85 R, 511, 61.43; 335/2; 338/99, 114

[56] References Cited

U.S. PATENT DOCUMENTS

| | | | |
|---|---|---|---|
| 3,383,487 | 5/1968 | Wiener | 335/2 |
| 4,088,856 | 5/1978 | Tebben | 200/52 R |
| 4,172,216 | 10/1979 | O'Shea | 200/85 R |
| 4,207,444 | 6/1980 | Kley | 200/5 A |
| 4,503,416 | 3/1985 | Kim | 338/99 |
| 4,707,576 | 11/1987 | Gessinger et al. | 200/262 |
| 4,742,196 | 5/1988 | Kelly | 200/86 R |
| 5,023,418 | 6/1991 | Beckhausen | 200/61.43 X |
| 5,072,080 | 12/1991 | Beckhausen | 200/61.43 |

FOREIGN PATENT DOCUMENTS

| | | | |
|---|---|---|---|
| 0178488 | 9/1985 | European Pat. Off. | H01H 3/14 |
| 0353332 | 8/1988 | European Pat. Off. | E05F 15/00 |
| 6901217 | 1/1969 | Germany . | |
| 2300222 | 1/1973 | Germany | H01H 11/00 |
| 3304400 | 2/1983 | Germany | F16P 3/08 |
| 3406366 | 2/1984 | Germany | H01C 17/06 |
| 3423163 | 6/1984 | Germany | B29C 67/14 |
| 3532963 | 9/1985 | Germany | H01H 1/02 |
| 9213726 | 10/1992 | Germany | H01H 13/16 |
| 9215176 | 11/1992 | Germany | H01H 13/16 |
| 2045527 | 3/1979 | United Kingdom | H01H 3/14 |

*Primary Examiner*—J. R. Scott
*Attorney, Agent, or Firm*—Synnestvedt & Lechner

[57] ABSTRACT

A safety switch (1) has a support (2) of an elastomer and a through-going cavity (3). Within the cavity (3) are arranged electrical conductors (4) and (5) which in a rest condition are arranged at a distance (9) from one another. The electrical conductors (4, 5) are each formed as a strip of carbon fibers and have one broad side (6) and (7) vulcanized to the support (2) either directly or by way of a coupling layer (8). Substantially perpendicular pressure (12, 13) on the safety switch (1) leads to the deformation of the support (2) and eventually to the contact of the electrical conductors (4, 5) with each other. By this means, safety functions are controlled.

20 Claims, 2 Drawing Sheets

SAFETY SWITCH HAVING A CARBON FIBER CONDUCTOR

BACKGROUND OF THE INVENTION

The invention relates to a switch, and more particularly to a safety switch having a support encompassing an elongate cavity in which two elongate electrical conductors are arranged spaced and electrically insulated from one another in a rest condition. The support is reversibly deformable by the application of an external force in such a manner that the electrical conductors come into contact with each other to produce an electrical signal indicative of the operational condition.

In one known switch of this type (DE-Auslegeschrift 2 300 222) each conductor consists of a strip of brass-plated copper wires which have been woven as a tube and then compressed. The support is formed as a tubular sleeve of an adhesive rubber mixture, possibly from elastomers and thermoplasts having similar properties. The metallic conductor strips have one broad side connected to the tubular sleeve by co-extrusion and vulcanization.

From DE 92 13 726 U1 it is known per se to produce opposing flexible conductors within a tube from a mixture which contains a conductive powder, for example copper powder, graphite powder or carbon powder.

From DE 34 23 163 A1 it is known per se to reinforce elastomeric bodies with carbon fibers by a process in which a carbon-multifilament yarn is coated with a latex dispersion, is dried, is cut into sections having lengths of 1 to 20 mm and is formed into a mass of fiber sections by swirling in an air stream. The fibrous mass is mixed with an elastomer and the mixture is rolled out.

DE 35 32 963 A1 shows that it is known per se to embed carbon fibers in a carbon matrix for arc lamp electrodes in order to increase their mechanical strength.

From DE 34 06 366 C2 it is known per se to embed carbon fibers, carbon fiber bundles or carbon fiber rovings as electrical switch means flush with the surface in the profile of a support substrate of a linear potentiometer.

DE-GM 69 01 217 shows that it is known per se to provide a switch with a housing part which is substantially U-shaped in cross section. The free ends of the limbs of the housing part are provided internally with longitudinal grooves into which complementary elongate webs of a substantially flat, flexible wall part which carries a movable contact strip are introduced. A fixed contact strip is anchored in the base of the housing part.

From EP 178 488 A2 it is known per se to print parallel conductor tracks on a foil strip in the longitudinal direction. The foil strip is then bent over about a longitudinal axis. The longitudinal edges of the foil strip are fixed continuously to one another by adhesive so that a cavity is created in which the conductor tracks in the rest condition are spaced in opposition to one another.

From DE 92 15 176 U1 there is known a safety profile member made from an electrically insulating rubber or synthetic rubber material. A switch channel accepts electrically conductive contact strips. The ends of the switch channel are sealed off by closure caps of an electrically insulating thermoplastic elastomer.

One known safety switch (DE 33 04 400 C2) is integrated into an elastomeric hollow profile. From the periphery of its cavity there extends a wedge-shaped rib as far as beyond the longitudinal axis of the cavity. The surface of the rib is made electrically conductive, just as is a peripheral surface region of the cavity which lies opposite the apex of the rib. However, the manufacture of this electrical conductor is complex and is limited to profiles having comparatively wide cavities.

A similar safety switch is known from EP 353 332 A1. Here, the rib as a whole and the entire thickness of the opposing wall of the tubular base member are made electrically conductive by the mixing in of electrically conductive materials, such as carbon black, graphite or metal powder. In order to improve the electrical conductivity an electrical conductive wire or strand is embedded without insulation in the rib and also in the tube wall.

From U.S. Pat. No. 4,172,216 A there is known a safety switch mat. The mat is composed of three layers, namely a substantially stiff, electrically conductive base layer with prominent portions formed thereon, a resilient, electrically insulating intermediate layer with holes through which the prominent portions extend, and a resilient, electrically conductive cover layer. The prominent portions will only upon mechanical loading of the mat enter into contact with the cover layer. The conductive layers are of plastics material into which carbon powder has been introduced, and are each connected to an electrical circuit lead.

It is the object of the invention to create a cost-effective and functionally reliable switch even with a comparatively narrow cavity.

SUMMARY OF THE INVENTION

This object is achieved in accordance with the present invention which, in broad terms, provides a switch having a flexible support shaped to form an internal elongate cavity. Arranged on the support within the cavity are two elongate electrical conductors. The switch has a rest position wherein the two conductors are spaced and electrically insulated from one another. At least one of the electrical conductors has carbon fibers.

The support is reversibly deformable by the application of an external force in such a manner that the electrical conductors, in an operational condition, come into contact with each other and produce an electrical signal indicative of the operational condition.

The carbon fibers have an electrical conductivity which is fully sufficient for this purpose. They are very light and cannot corrode. Moreover, the carbon fibers are very flexible and have a high tensile strength, with the result that one achieves a stabilization of the support in the longitudinal direction which is highly desirable in many cases. If one of the two electrical conductors is essentially stationary, then at least the other electrical conductor which is movable relative to the stationary electrical conductor is made of carbon fibers.

Due to the outstanding flexibility of the carbon fibers, there is no noticeable increase in the actuating forces necessary to deform the support and to bring the two electrical conductors into contact with one another. This contact generally has the result of producing an electrical signal which is sent by way of the electrical conductors, and by which an electrical control circuit can be activated. By means of the control circuit one can carry out switching of safety functions. As soon as this has taken place, the electrical conductors may move back again from their operational condition to their rest condition in which they are separated from one another.

The carbon fibers can be formed into a filamentary yarn which is formed by a strand of carbon fibers which are set parallel to one another or, if necessary, can be twisted together. The carbon fibers of filamentary yarn can be pre-fixed to prevent any possible escape of any individual carbon fibers.

An electrically conductive bonding agent can be used to pre-fix the carbon fibers. This is of particular advantage if the filamentary yarn is to be connected for example to a support made of elastomers or thermoplastic elastomers. Incidentally, any material can be used as the fixing material, provided that it is suitable for the fixing of carbon fibers and does not adversely affect the fixing of the filamentary yarn to the support or the electrical conductivity of the filamentary yarn.

The carbon fibers can be made into a string as necessary to increase the cross section of the electrical conductors made from carbon fibers. Here the filamentary yarns are twisted together. These again can be pre-fixed together in a manner already described above, before they are connected to the support.

The carbon fibers can also be made into a strip. With the strip one has an electrical conductor which is comparatively flat but nevertheless switches very reliably. The strip can be woven or plaited for example from filamentary yarns.

The carbon fibers also can be made into a tubular structure where the carbon fibers are held in a very securely bound state. The tube can be knitted for example from filamentary yarn or can be produced in some other manner known per se.

The support of the switch can be made of at least one elastomer. This structure is suitable primarily for sealing profiles or edge-protecting profiles, such as are used for example in the construction of vehicles. Profiles equipped in this way can in practice follow any contour of the vehicle without adopting an appreciable bending resistance through the electrical conductor. The electrical conductors made of carbon fibers ensure in this case that there is a desirable longitudinal stability for the profile.

The support of the switch can also be made of at least one thermoplastic elastomer and be formed together with at least one of the electrical conductors in a heatable shaping tool. Any particular shape for the safety switch and at the same time for its support is possible. At the same time, the cavity can be closed at its two ends in a manner which seals it against moisture so that the cavity is closed in a manner which is hermetically sealed and thus guarantees that the function of the safety switch will be unimpaired. The shaping tool can work for example according to a compression process and/or a transfer moulding process and/or according to an injection moulding process.

Further features and advantages of the invention will become apparent from the following description of a number of embodiments of the safety switch which are given by way of example and with reference to the drawings.

DESCRIPTION OF THE PREFERRED EMBODIMENTS

Figure 1:
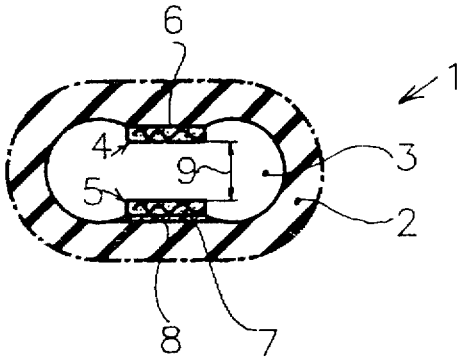
FIG. 1 is a cross-section through a first embodiment of safety switch in the rest condition.

FIG. 1 shows a safety switch 1 with a support 2 which in this case is formed as a profile extruded from an elastomer. The external contour of the support is indicated by a chain-dotted line in order to indicate that this contour can be extended as needed. Thus, on the support 2 one could form a retaining section for example, by means of which the support could be fixed to a flange of a vehicle, and sealing lips or masking lips of different shapes could also be formed on the support.

The support encloses an elongate cavity 3 in which two elongate parallel electrical conductors 4 and 5 are arranged.

Figure 6:
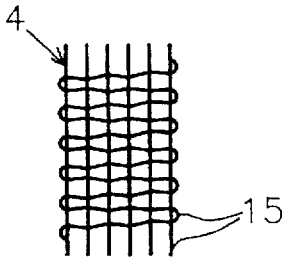
FIG. 6 is a schematic plan view of a woven strip of carbon fiber filaments.
Figure 7:
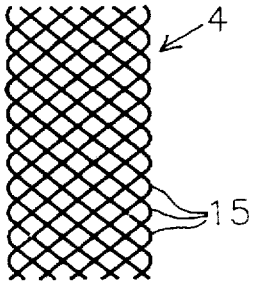
FIG. 7 is a schematic plan view of a strip produced from carbon fiber filaments.

The electrical conductors 4, 5 are each formed as a strip of carbon fibers, for example as shown in FIG. 6 or FIG. 7. The electrical conductors 4, 5 are co-extruded with the support 2. The electrical conductor 4 has one broad side 6 vulcanized directly to the support 2. The electrical conductor 5 on the other hand has one broad side 7 bonded to the support 2 by a coupling layer 8. The coupling layer 8 can be a bonding agent for example.

FIG. 1 shows the components of the safety switch in their rest condition, in which the electrical conductors 4 and 5 are arranged at a distance 9 from each other.

In all the Figures of the drawings the same or corresponding parts are indicated by the respective same reference numerals.

In FIG. 2 the safety switch 1 again has the electrical conductor 5 made as a strip of carbon fibers which is directly vulcanized to the support 2. The opposing electrical conductor 10 is in this case formed as a thin flexible metal strip having good electrical conductivity. The electrical conductor 10 can, as indicated in FIG. 2, be co-extruded together with the support 2 and vulcanized to it directly or by way of a bonding agent.

Figure 2:
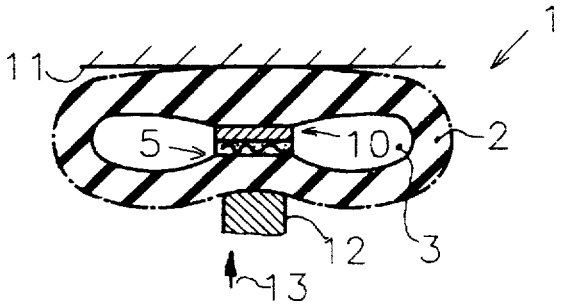
FIG. 2 is a cross-section through another embodiment of safety switch in its operational condition.

FIG. 2 shows the electrical conductors 5, 10 in their operational condition in which the electrical conductors make contact. The upper boundary of the support 2 in FIG. 2 is in contact with a stationary abutment 11 and an actuating force has been exerted on the safety switch 1 by a body 12 in the direction of an arrow 13. By means of this the support 2 has been deformed until the electrical conductors 5 and 10 made contact. By means of this contact there results a change in the electrical circuit containing the electrical conductors 5 and 10. Thus, in a manner known per se, by means of an associated control circuit, safety functions can be controlled, for example the drive of electrically actuated motor vehicle windows or roller doors which can either be switched off or set to move in the opposite direction.

Figure 3:
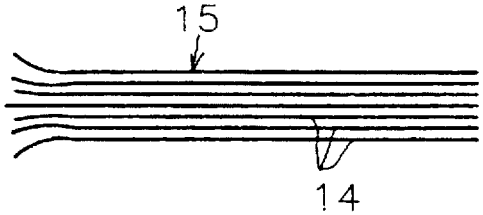
FIG. 3 is a side view of a filamentary yarn of carbon fibers.

FIG. 3 shows schematically how a filamentary yarn 15 is manufactured from individual, very thin carbon fibers 14. Customarily, several thousand carbon fibers 14 make up one such filamentary yarn 15 which incidentally is rotated about its longitudinal axis in order to achieve mutual stabilization of the carbon fibers 14.

Figure 4:
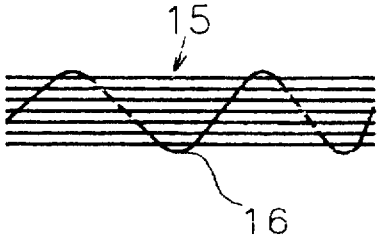
FIG. 4 shows a filamentary yarn according to FIG. 3 bound before use with a fixing thread.

In order to offer a lateral containment of the individual carbon fibers 14 and substantially prevent the shedding of fibers, the filamentary yarn 15 according to FIG. 4 can be pre-fixed before use by a fixing thread 16 wound externally around the filamentary yarn 15 before it is combined with and fixed to the support 2 as shown in FIG. 1.

Figure 5:
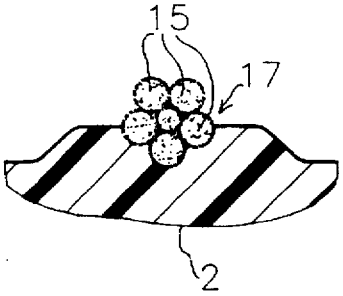
FIG. 5 is a cross-section through one part of another safety switch having a string of carbon fiber filaments.

According to FIG. 5, six filamentary yarns 15 are twisted together to make a string 17 of carbon fibers. The string 17 forms one electrical conductor which has a part of its periphery embedded in the support 2 to which it is fixed. The fixing can be directly without a coupling layer or can incorporate a coupling layer. In the case of FIG. 5 the support is made of a thermoplastic elastomer (TPE) which can be combined with the string 17 by co-extrusion or which can be connected to it in a shaping process.

FIG. 6 shows schematically how the strip-like electrical conductor 4 is woven from filamentary yarns 15 which form both the warp threads and also the weft threads.

According to FIG. 7, the strip-like electrical conductor 4 is again made of filamentary yarns 15 of carbon fibers which are plaited together.

Figure 8:
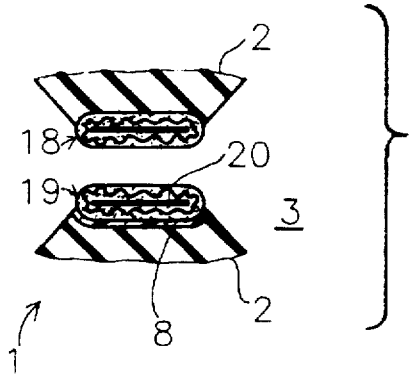
FIG. 8 shows one part of yet another safety switch, in which the electrical conductors are formed as tubes; and, FIG. 9 is a cross-section through another safety switch with an integrated mounting rail.

In the case of the safety switch 1 which is partially shown in FIG. 8, electrical conductors 18 and 19 which are each tubular are provided. The electrical conductors 18, 19 have been pressed flat during the connection of them to the support 2 and remain substantially in this pressed-flat form. In order to promote this, a coupling layer 20 can enhance the adhesion of the two webs of the electrical conductor 19 to each other. The electrical conductor 18 is vulcanized directly to the support 2, while the electrical conductor 19 achieves its bonding to the support 2 by means of the coupling layer 8.

In FIGS. 1 to 8 the material of the support 2 is in each case electrically non-conductive. However, one could alternatively have an arrangement in which one strand of the support 2 defining the electrical conductor is electrically non-conductive and the support 2 is otherwise electrically conductive.

Figure 9:
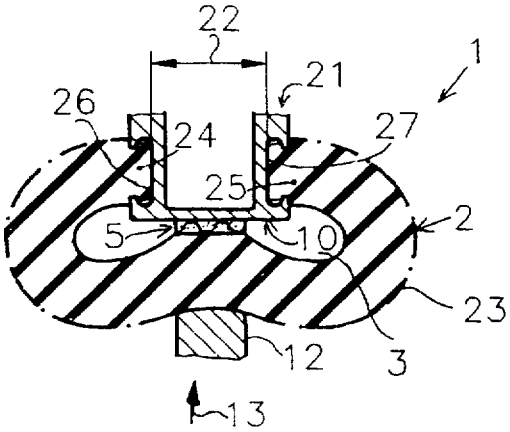

In the case of the safety switch 1 shown in FIG. 9 the support 2 includes a totally electrically conductive mounting rail 21 which on its side facing the electrical conductor 5 forms the electrical conductor 10.

Alternatively, one could make only the region of the mounting rail 21 which corresponds to the electrical conductor 10 electrically conductive, while the rest of the mounting rail 21 would be electrically non-conductive. This could be achieved for example by fixing an electrical conductor responding to the electrical conductor corresponding to the electrical conductor 10 of FIG. 2 to the mounting rail 21.

The support 2 shown in FIG. 9 further comprises a profile section 23 which has a gap 22 in its periphery. The profile section 23 can be made for example from an elastomer. The longitudinal edges 24 and 25 of the profile section 23 which define the gap 22 are of T-shaped cross-section and are set into corresponding lateral grooves 26 and 27 of the mounting rail 21.

Again in FIG. 9 the safety switch 1 is represented in its operational condition, as with FIG. 2, where the electrical conductors 5, 10 are in contact. Upon removal of the actuating member 12 the profile section 23 again resumes its rest condition corresponding to FIG. 1, in which the electrical conductors 5, 10 are separated from one another.

As elastomers for the support 2 one can use the following materials for example:

Expanded rubber with a Shore-A hardness of 10 to 30, or soft rubber with a Shore-A hardness of 30 to 70, both made for example from

EPDM,

SBR,

CR,

ECO, blends (mixtures) of EPDM with SBR having an EPDM constituent of 20 to 90% by weight, blends of EPDM with SBR and/or polyoctenamer, or NBR.

The following thermoplastic elastomers (TPE) can be used for example for the support 2:

TPE based upon styrene ethylene butylene styrene (S-EB-S),

TPE based upon styrene butadiene styrene (SBS),

TPE based upon styrene isoprene styrene (SIS),

TPE based upon elastomer compositions as TPO blends or

TPO alloys, for example of cross-linked EPDM/propylene blends (EPDM/PP) or

Ethylene vinyl acetate/vinylidene chloride (EVA/PVDC) or

TPE based upon thermoplastic polyurethane (TPU).

The support 2 can be composed also of profile sections of elastomers and thermoplastic elastomers which each are formed by an elastomer extruder and are subsequently vulcanized to one another along the boundary surfaces which come into contact with each other. In this way a chemical bond of sufficient strength is created between the profile sections.

We claim:

1. A safety switch comprising:

a flexible support shaped to form an internal elongate cavity;

two elongate approximately parallel electrical conductors arranged on said support within said cavity, said switch having a rest position wherein said two conductors are spaced and electrically insulated from one another;

at least one of said electrical conductors consisting essentially of carbon fibers; and said support being reversibly deformable by the application of an external force in such a manner that the electrical conductors, in an operational condition, come into contact with each other and produce and electrical signal indicative of the operational condition.

2. A switch according to claim 1, wherein the carbon fibers form a filamentary yarn.

3. A switch according to claim 2, wherein the carbon fibers of the filamentary yarn are fixed relative to one another.

4. A switch according to claim 3, wherein the carbon fibers include a fixing thread wound around the filamentary yarn to fix the carbon fibers.

5. A switch according to claim 3, wherein said carbon fibers are fixed to one another by an electrically conductive bonding agent.

6. A switch according to claim 1, wherein the carbon fibers form a string.

7. A switch according to claim 1, wherein the carbon fibers form a strip having one broad side fixed to the support.

8. A switch according to claim 1, wherein the carbon fibers form a tube which is fixed in a pressed-flat form to the support.

9. A switch according to claim 1, wherein the support comprises at least one elastomer.

10. A switch according to claim 9, wherein at least one of the electrical conductors is bonded by co-extrusion and co-vulcanization to said at least one elastomer.

11. A switch according to claim 1, wherein the support comprises at least one thermoplastic elastomer (TPE).

12. A switch according to claim 11, wherein at least one of the electrical conductors and said at least one thermoplastic elastomer (TPE) are formed together in a heatable shaping tool by being made plastic with subsequent hardening (freezing in) of the TPE such that the electrical conductor has a part of its circumference bonded to the TPE.

13. A switch according to claim 1, wherein the support is formed as an integrally continuous profile which completely encloses said cavity in a circumferential direction of said support.

14. A switch according to claim 1, wherein said support has longitudinal edges defining a gap in a circumferential direction of said support, said switch further comprising a mounting rail, at least part of said mounting rail forming one of the electrical conductors, and said longitudinal edges being fixed to said mounting rail.

15. A safety switch, comprising;

a deformable support shaped to form an internal elongate cavity;

two elongate electrical conductors arranged on said support within said cavity spaced and electrically insulated from one another when said switch is in a rest condition;

said support being reversibly deformable by applying an external force whereby said electrical conductors can electrically contact one another indicative of said switch being in an operational condition; and wherein at least one of said electrical conductors comprises carbon fibers positioned to contact the other of said two conductors in the operational position.

16. A switch in accordance with claim 15 wherein said carbon fibers form a filamentary yarn.

17. A switch in accordance with claim 16 wherein said filamentary yarn is prefixed to contain said carbon fibers.

18. A switch in accordance with claim 15 wherein said carbon fibers form a string.

19. A switch in accordance with claim 15 wherein said carbon fibers form a strip having a broad side fixed to said support.

20. A switch in accordance with claim 15 wherein said carbon fibers form a tube which is fixed in a pressed flat form to said support.

* * * * *